US007038402B1

(12) United States Patent
Adler et al.

(10) Patent No.: US 7,038,402 B1
(45) Date of Patent: May 2, 2006

(54) COMBINED EXPONENTIAL/LINEAR RGB LED I-SINK DIGITAL-TO-ANALOG CONVERTER

(75) Inventors: Andreas Adler, Schlierbach (DE); Carlo Peschke, Kirchheim/Teck (DE)

(73) Assignee: Dialog Semiconductor GmbH, Kirchheim/Teck-Nabern (DE)

( * ) Notice: Subject to any disclaimer, the term of this patent is extended or adjusted under 35 U.S.C. 154(b) by 0 days.

(21) Appl. No.: 10/999,827

(22) Filed: Nov. 30, 2004

(30) Foreign Application Priority Data

Nov. 23, 2004 (EP) ..... 04392045

(51) Int. Cl.
*H05B 37/00* (2006.01)

(52) U.S. Cl. ..... 315/312; 315/313; 315/291

(58) Field of Classification Search ..... 315/312, 315/313

See application file for complete search history.

(56) References Cited

U.S. PATENT DOCUMENTS

| | | | | |
|---|---|---|---|---|
| 4,244,024 | A * | 1/1981 | Marzalek et al. | 702/68 |
| 4,539,883 | A * | 9/1985 | Chihana | 84/625 |
| 4,631,696 | A | 12/1986 | Sakamoto | 364/748 |
| 6,008,820 | A * | 12/1999 | Chauvin et al. | 345/502 |
| 6,340,868 | B1 * | 1/2002 | Lys et al. | 315/185 S |
| 6,362,578 | B1 | 3/2002 | Swanson et al. | 315/307 |
| 6,388,388 | B1 * | 5/2002 | Weindorf et al. | 315/169.3 |
| 6,586,890 | B1 | 7/2003 | Min et al. | 315/224 |
| 6,596,977 | B1 | 7/2003 | Muthu et al. | 250/205 |
| 6,774,583 | B1 * | 8/2004 | Zeng | 315/312 |
| 2003/0057890 | A1 | 3/2003 | Lys et al. | 315/295 |
| 2003/0234621 | A1 | 12/2003 | Kriparos | 315/224 |
| 2005/0063586 | A1 * | 3/2005 | Munsil et al. | 382/162 |

OTHER PUBLICATIONS

Co-pending U.S. Appl. No. DS-04-044, filed Nov. 16, 2004, Serial No. 10/990,004, assigned to the same assignee, "Floating Point IDAC".

* cited by examiner

*Primary Examiner*—Trinh Vo Dinh
*Assistant Examiner*—Marie Antoinette Cabucos
(74) *Attorney, Agent, or Firm*—George D. Saile; Stephen B. Ackerman

(57) ABSTRACT

Methods and systems to achieve linear and exponential control over a current to drive color LEDs have been achieved. Current digital-to-analog converters (IDAC) comprising each an exponential current digital-to analog converter and a linear IDAC, being cascaded to each other are used for a linear and an exponential control of a current driving a set of color LEDs, preferably RGB LEDs. The linear part of the IDAC, which is converting the mantissa of a floating-point number is used to control the color composition of the color LEDs. The exponential part of the IDAC, which is converting the exponent of the floating-point number is used to control the brightness of the color LEDs. While fading from one color to a next color a linear color change is required. The exponential part of the IDAC is used to dim the LEDs from bright to dark and vice versa. In order to get the visual perception of a linear dimming an exponential current change is required.

12 Claims, 2 Drawing Sheets

COMBINED EXPONENTIAL/LINEAR RGB LED I-SINK DIGITAL-TO-ANALOG CONVERTER

BACKGROUND OF THE INVENTION

This application is related to U.S. patent application Ser. No. 10/990,004 filed: Nov. 16, 2004 and assigned to the same assignee as the present invention.

(1) Field of the Invention

This invention relates generally to the control of light emitting diodes (LED) currents, and more particularly to the control of the color and brightness of RGB LEDs.

(2) Description of the Prior Art

LED brightness control is typically achieved by controlling the current that passes through the LED. In order to dim LEDs with less power dissipation than current control, a method of power control is used known as Pulse Width Modulation (PWM). By varying the average current across the diode, the device can be made to appear dimmer or brighter or, in the case of RGB LEDs the color can be controlled.

The control of color and brightness of LEDs requires high PWM frequencies causing therefore high power dissipation compared to lower frequencies. A sole linear current digital-to-analog solution has the disadvantage of being perceived by human visual perception as a non-linear dimming.

There are various patents known dealing with the control of LEDs.

U.S. Pat. No. 6,586,890 to Min et al.) describes a driver circuit for light emitting diodes (LEDs) providing power to LEDs using pulse width modulation (PWM). The driver circuit uses current feedback to adjust power to LED arrays and provides a full light and a dim mode.

U.S. Pat. No. 6,596,977 to Muthu et al.) discloses an LED array being controlled by determining a constant relating the peak light output of an LED to the peak driving current of a PWM pulse driving the LED, and multiplying the average current of the PWM pulse by the constant to obtain a value of average light output for the LED. The constant may be determined by simultaneously measuring peak light output of the LED and peak current of a PWM pulse driving the LED. The constant is then calculated by dividing the peak light output by the peak current of the PWM pulse. By making the simultaneous measurements at a time during the duration of the PWM pulse where the pulse has reached its full magnitude, rise and fall times of the pulse do not affect the measurements. The average current of the PWM pulse may be determined by a variety of methods including integrating current in the PWM pulse over time, or passing the PWM current through a low pass filter configured for providing an average value of PWM current. Determining average current in this manner further reduces the effect of rise and fall time on determining the average light output of the LED.

U.S. Pat. No. 6,362,578 to Swanson et al.) teaches an LED driver circuit and method where an array of light emitting diodes has a transistor connected to each respective array of light emitting diodes. A PWM controller has an input for receiving a voltage reference and an output connected to selected transistors for driving selected transistors and setting a PWM duty cycle for the selected arrays of light emitting diodes to determine the brightness of selected light emitting diodes. An oscillator is connected to the PWM controller for driving the PWM controller.

SUMMARY OF THE INVENTION

A principal object of the present invention is to achieve a method for a linear and exponential control over a driving current of color LEDs.

Another principal object of the present invention is to achieve a system for a linear and exponential control over a driving current of color LEDs.

A further objective of the present invention is to achieve a visual perception of a linear dimming of color LEDs.

In accordance with the objects of this invention a method to achieve linear and exponential control over a current to drive color LEDs has been invented. This method comprises, first, (1) to provide a control unit for current digital-to-analog converters, a Digital Switches Control unit, at least one set of color LEDs, and a linear current digital-to-analog converter cascaded with an exponential current digital-to-analog converter. The next steps of the method invented are (2) to activate a first color of color space of the color LEDs by the Digital Switches Control unit, (3) to define a floating-point number wherein its mantissa defines the color composition of the color LEDs and its exponent defines the brightness of the LEDs, and (4) to split said floating-point number into its mantissa and exponent. The following steps of the method invented comprise (5) to convert said exponent to a current representing an analog signal of the exponent using said exponential current digital-to-analog converter, (6) to convert said digital floating point number into an analog current by converting linearly said mantissa by said linear current digital-to-analog converter using the output current of the previous step as biasing reference current, and (7) to use the output current of said cascaded exponential and linear digital-to-analog converters for the currently color of the color LEDs in order to achieve linear and exponential control over a current to drive said color LED. The final steps comprise (8) to check if the currently assigned color is the last color of the color space used. If this check is positive the process flow goes back to step (2), otherwise the process flow goes to step (9) wherein the next color of the color space of the color LEDs is activated by said Digital Switches Control unit. The process flow goes then to step (3).

In accordance with the objects of this invention a method to achieve linear and exponential control over a current to drive color LEDs has been achieved. This method comprises, first, (1) to provide a control unit for current digital-to-analog converters, a Digital Switches Control unit, at least one set of color LEDs, and an exponential current digital-to-analog converter cascaded with a linear current digital-to-analog converter. The next steps of the method invented are (2) to activate a first color of color space of color LEDs by said Digital Switches Control unit, (3) to define a floating-point number wherein its mantissa defines the color composition of the color LEDs and its exponent defines the brightness of the LEDs, (4) to split said floating-point number into its mantissa and exponent, (5) to convert said mantissa to a current representing an analog signal of the mantissa using said linear current digital-to-analog converter, and (6) to convert said digital floating point number into an analog current by converting said exponent by said exponential current digital-to-analog converter using the output current of the previous step as biasing reference current. The last steps of the method invented are (7) to use the output current of said cascaded exponential and linear digital-to-analog converters as current sink for the currently assigned color of the color LEDs in order to achieve linear and exponential control over a current to drive said color LED, (8) to go to step 2 if the currently assigned color is the last color of the color space used, otherwise go to step (9), and (9) to activate next color of color LEDs by said digital switches unit and go to step (3).

In accordance with the objects of this invention a system to achieve linear and exponential control over a current to drive color LEDs has been invented The system invented comprises, firstly, a Fade/Dim control unit, controlling the brightness and the color composition of color LEDs having inputs and output, wherein the inputs comprises image data to be displayed by said color LEDs and signals defining changes in regard of color composition and brightness of said color LEDs, a White Balancing unit, performing white balancing of the brightness of said image data to correct for incandescent or fluorescent lighting, having inputs and output, wherein its input is the output of said Fade/Dim control unit and its output are corrected image data to be displayed comprising color composition and brightness control information, and a digital Switching Control unit activating power lines supplying individual colors to said sets of color LEDs, having input and output wherein the input comprises said image data defining colors required to be displayed by said sets of color LEDs and the output comprises signals to each current line supplying LEDS of a correspondent color. Furthermore the system invented comprises a digital current digital-to-analog converter control unit, controlling a number of floating-point number current digital-to-analog converters, having inputs and outputs, wherein the inputs are control signals defining brightness and color composition of said LEDs and said outputs are mantissas and exponents of floating point numbers, wherein said exponents are defining the brightness of said LEDs and said mantissas are defining the color composition of said LEDs, Finally the system invented comprises a number of floating-point number current digital-to-analog converters, wherein each is driving one set of color LEDS and each is having inputs and an output, wherein a first input is an exponent from said current digital-to-analog converter control unit, and a second input is a mantissa from said current digital-to-analog converter control unit and the output is a current sink, driving one correspondent set of color LEDs, being correlated to the value of said floating-point number being represented by said mantissa and exponent, and a number of sets of color LEDs, having each two terminals wherein one terminal is connected to one of said power lines of a correspondent color and a second terminal is connected to one of said floating-point number current digital-to-analog converters.

BRIEF DESCRIPTION OF THE DRAWINGS

In the accompanying drawings forming a material part of this description, there is shown.

DESCRIPTION OF THE PREFERRED EMBODIMENTS

The preferred embodiments of the present invention disclose novel methods and systems to control the color composition and the brightness of color LEDs, as e.g. RGB LEDs.

Figure 1A:
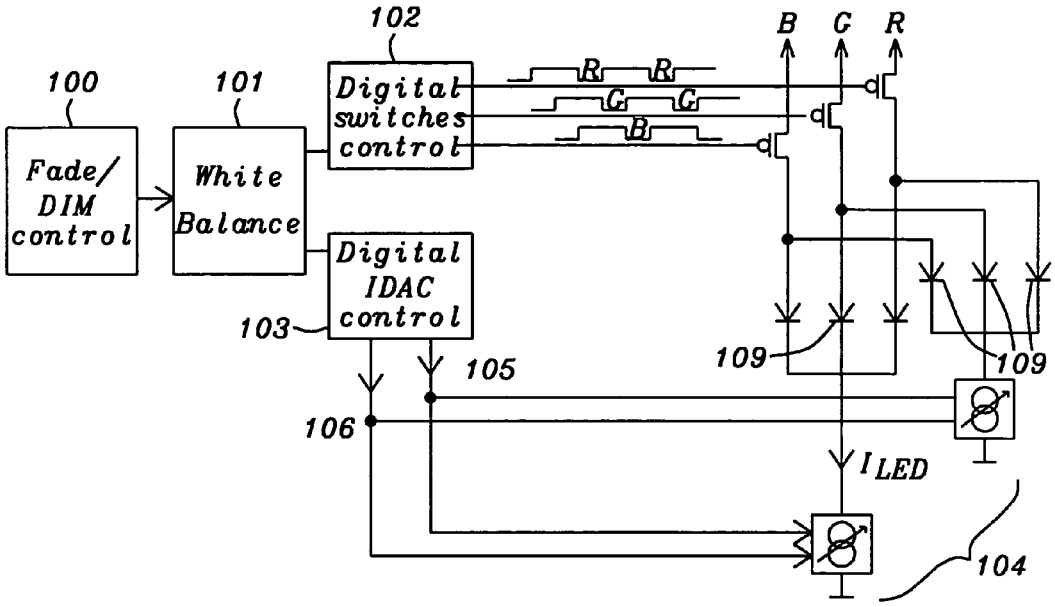
FIG. 1*a* shows a block diagram of the system invented.

FIG. 1*a* shows a principal block diagram of a preferred embodiment of the present invention. There are various sets 109 of RGB LEDs. A single set 109 comprises a red, a blue and a green LED. Multiple sets are connected in parallel to each other All LEDs of one color are connected to a correspond power line. All green LEDs are connected to the green G line; all blue LEDs are connected the blue B line, and all red LEDs are connected to the red R line.

It has to be understood that LEDs having other colors besides red, green and blue can be used of course as well. The number of LEDs one IDAC can control is limited to the number of switches available.

A Fade/Dim control block 104 receives raw image data and control signals. The next block 101 performs white balancing of the digital image to correct for incandescent or fluorescent lighting. The output of the white balance block 101 is the input of a Digital Switches Control block 102 and of a digital current digital-to-analog converter (IDAC) control block 103.

The data for the fade/dim control 104 provides information for the exponent for the entire RGB LED and the mantissa for each color of the RGB LED. Additionally information about the dim/fade duration and the step size is provided. In this block the dimming from the current exponent to the next exponent (for the brightness) and the fading from the current mantissa to the next mantissa (for the composed color) is defined.

The white balance block 101 modifies the one exponent (brightness) received as input for the RGB LED into one exponent for each color of the RGB LED (one for red, one for green and one for blue). This is done by a multiplication with the correction value of each color (R, G and B).

If the green LED is selected by the digital switches control 102, the current digital-to-analog converter (IDAC) 104 assigned to a RGB LED gets the green mantissa and the corrected exponent, wherein the exponent is defining the brightness, which is the total brightness multiplied by the green correction value, and the mantissa is defining the color composition.

The Digital Switches Control block 102 activates via pulses the color power lines of Red, Green, and Blue. The Digital IDAC Control block 103 provides input in form of mantissas and exponents of digital floating-point numbers to an arrangement of current digital-to-analog converters (IDAC) 104.

One IDAC 104 for each set of RGB LEDs is required. Each IDAC needs it's own digital control signals from the Digital IDAC control block 103. If the green line is selected, all green LEDs are on and all IDACs connected to the green LEDs are loaded with their green mantissa and exponent values.

These IDACs 104 are the same current digital-to-analog converters as described in the U.S. patent application Ser. No. 10/990,004 filed: Nov. 16, 2004, and assigned to the same assignee as the present invention. The IDACs 104 convert directly the mantissas and exponents of their input into an analog current. Each IDAC 104 receives two inputs from the Digital IDAC Control 103. A first input 105 is a binary vector comprising an exponent of an floating-point number to be converted into an analog current, a second input 106 is a binary vector comprising a mantissa of a floating-point number to be converted linearly into an analog current wherein said analog current converted is a biasing current for said linear conversion.

Figure 1B:
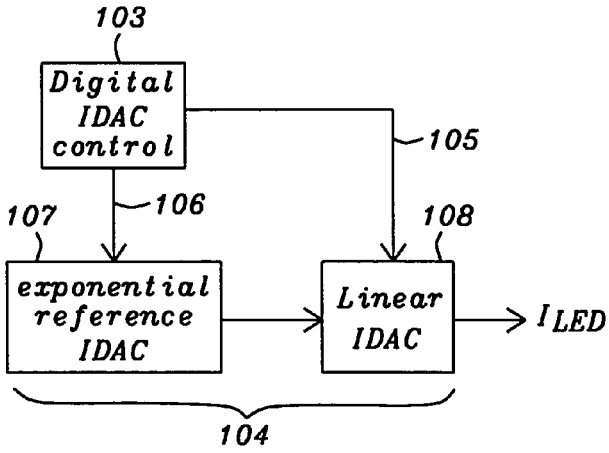
FIG. 1*b* illustrates a more detailed block diagram of the current digital-to analog converter used as a current sink to drive color LEDs.

FIG. 1*b* shows a detailed structure of an IDAC 104. Each IDAC 104 has two parts cascaded to each other. A first part 107 is an exponential current digital-to-analog converter converting the exponent of said floating-point number into an analog current and a second part 108 is a linear current digital-to-analog converter converting the mantissa of said floating-point number linearly into an analog current, wherein the analog current output of said first part 107 is used as biasing current of said second part. The output ILED of said IDAC 104 is an analog current being directly correlated to the value of the floating-point number provided by the Digital IDAC Control block 103 in form of its mantissa and exponent.

It has to be understood that the exponential IDAC 107 and the linear IDAC 108 are commutatively related as described in the U.S. patent application Ser. No. 10/990,004 filed: Nov. 16, 2204 and assigned to the same assignee as the present invention. This means that the sequence of both IDACs can be interchanged. In FIG. 1*b* the exponential IDAC 107 is biasing the linear IDAC 108. The same results are achieved if the sequence of both IDACs is interchanged and the linear IDAC 108 is biasing the exponential IDAC 108.

Each set of RGB LEDs 109 is assigned to one correspondent IDAC 104. Each IDAC 104 works as a current sink for its correspondent set of RGB LEDs.

The linear digital-to-analog converter 108 of the IDAC 104 is used for the color composition. In order to keep the brightness constant while fading from one color to a next color a linear current change is required.

The exponential converter 107 of an IDAC 104 is used to dim the LEDs from bright to dark or vice versa. In order to get the visual perception of a linear dimming an exponential current change is required. The combination of the linear function of the linear IDAC 108 with the exponential function of the exponential IDAC 107 provides the possibility to generate a color fading with a perceived constant brightness or a dimming with a perceived constant color or a combination of both.

Figure 2:
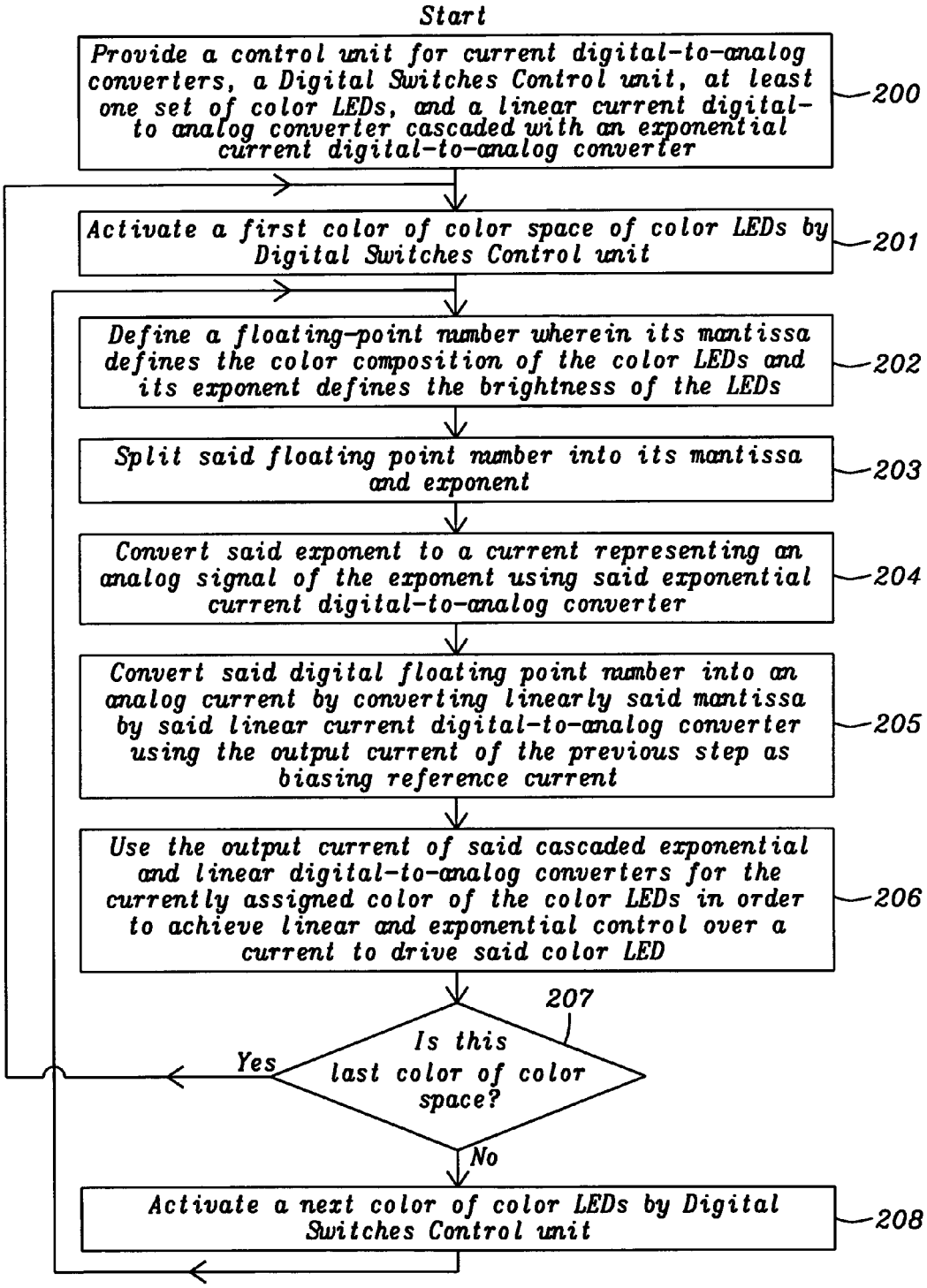
FIG. 2 shows a flowchart of the method invented to achieve linear and exponential control over a current to drive color LEDs.

FIG. 2 shows a flowchart of a method of the present invention to achieve linear and exponential control over a current to drive color LEDs using any color space, e.g. RGB color space, which is commonly used. Step 200 describes the provision of a control unit for current digital-to-analog converters, a Digital switches Control unit, at least one set of color LEDs, and a linear current digital-to-analog converter cascaded with an exponential current digital-to-analog converter. The next step 201 comprises the activation of a first color of color LEDs by Digital Switches Control unit. It has to be understood that an IDAC controls only one color at a point of time. In case of using e.g. RGB LEDS this first color may be red, followed at a later point of time by green and then by blue. This switching has to be fast enough that this RGB switching is not visible. In the following 202 step a floating-point number is defined wherein its mantissa defines the color composition of the color LEDs and its exponent defines the brightness of the LEDs. In the next step 203 said floating point number is split into its mantissa and exponent and in step 204 said exponent is converted to a current representing an analog signal of the exponent using said exponential current digital-to-analog converter. The next step 205 comprises the conversion of said digital floating point number into an analog current by converting linearly said mantissa by said linear current digital-to-analog converter using the output current of the previous step as biasing reference current. In step 206 the output current of said cascaded exponential and linear digital-to-analog converters is used for the currently assigned color of color LEDs in order to achieve linear and exponential control over a current to drive said color LED. The linear part of the control is used for the color composition of the color LED; the exponential part of the control is used to modify the brightness of the color LED In step 207 is a check if the last color of the color space used is activated. This means, in case of an RGB color space and if the sequence Red-Green-Blue is defined it is checked if the color blue has been already activated. In this case the process flow goes back to step 201, wherein the first color, in the example used it would be red, will be activated again. In case the last color is not yet activated the process flow goes to step 208 wherein the next color of the color space is activated and the process flow goes back to step 202 for further processing. This next color could be, in case of the example of an RGB color space either Green or Blue.

While the invention has been particularly shown and described with reference to the preferred embodiments thereof, it will be understood by those skilled in the art that various changes in form and details may be made without departing from the spirit and scope of the invention.

What is claimed is:

1. A method to achieve linear and exponential control over a current to drive color LEDs is comprising:

(1) provide a control unit for current digital-to-analog converters, a Digital Switches Control unit, at least one set of color LEDs, and a linear current digital-to-analog converter cascaded with an exponential current digital-to-analog converter;

(2) activate a first color of color space of color LEDs by said Digital Switches Control unit;

(3) define a floating-point number wherein its mantissa defines the color composition of the color LEDs and its exponent defines the brightness of the LEDs;

(4) split said floating-point number into its mantissa and exponent;

(5) convert said exponent to a current representing an analog signal of the exponent using said exponential current digital-to-analog converter;

(6) convert said digital floating point number into an analog current by converting linearly said mantissa by said linear current digital-to-analog converter using the output current of the previous step as biasing reference current;

(7) use the output current of said cascaded exponential and linear digital-to-analog converters as current sink for the currently assigned color of the color LEDs in order to achieve linear and exponential control over a current to drive said color LED;

(8) go to step 2 if the currently assigned color is the last color of the color space used, otherwise go to step (9); and (9) activate next color of color LEDs by said digital switches unit and go to step (3).

2. The method of claim 1 wherein said color LEDs are RGB LEDs.

3. The method of claim 1 wherein said linear current digital-to-analog converter cascaded with an exponential current digital-to-analog converter works as a current sink.

4. The method of claim 1 wherein said linear control is used to control the color composition of said color LEDs.

5. The method of claim 1 wherein said exponential control is used to control the brightness of said color LEDs.

6. The method of claim 1 wherein said exponential control is used to control the brightness of said color LEDs and said linear control is used to control the color composition of said color LEDs.

7. A method to achieve linear and exponential control over a current to drive color LEDs is comprising:

(1) provide a control unit for current digital-to-analog converters, a Digital Switches Control unit, at least one set of color LEDs, and an exponential current digital-to-analog converter cascaded with a linear current digital-to-analog converter;

(2) activate a first color of color space of color LEDs by said Digital Switches Control unit;

(3) define a floating-point number wherein its mantissa defines the color composition of the color LEDs and its exponent defines the brightness of the LEDs;

(4) split said floating-point number into its mantissa and exponent;

(5) convert said mantissa to a current representing an analog signal of the mantissa using said linear current digital-to-analog converter;

(6) convert said digital floating point number into an analog current by converting said exponent by said exponential current digital-to-analog converter using the output current of the previous step as biasing reference current;

(7) use the output current of said cascaded exponential and linear digital-to-analog converters as current sink for the currently assigned color of the color LEDs in order to achieve linear and exponential control over a current to drive said color LED;

(8) go to step 2 if the currently assigned color is the last color of the color space used, otherwise go to step (9); and (9) activate next color of color LEDs by said digital switches unit and go to step (3).

8. The method of claim 7 wherein said color LEDs are RGB LEDs.

9. The method of claim 7 wherein said exponential current digital-to-analog converter cascaded with a linear current digital-to-analog converter works as a current sink.

10. The method of claim 7 wherein said linear control is used to control the color composition of said color LEDs.

11. The method of claim 7 wherein said exponential control is used to control the brightness of said color LEDs.

12. The method of claim 7 wherein said exponential control is used to control the brightness of said color LEDs and said linear control is used to control the color composition of said color LEDs.

* * * * *